United States Patent [19]

Papp

[11] 3,993,130

[45] Nov. 23, 1976

[54] METHOD AND APPARATUS FOR CONTROLLING THE INJECTION PROFILE OF A BOREHOLE

[75] Inventor: John C. Papp, Natural Dam, Ark.

[73] Assignee: Texaco Inc., New York, N.Y.

[22] Filed: May 14, 1975

[21] Appl. No.: 577,363

[52] U.S. Cl. ..... 166/330; 166/305 R

[51] Int. Cl.[2] ..... E21B 43/12; E21B 43/16

[58] Field of Search ..... 166/305 R, 269, 258, 166/268, 284, 56, 101, 227, 236, 242, 224 R, 226

[56] References Cited

UNITED STATES PATENTS

| | | | |
|---|---|---|---|
| 2,055,515 | 9/1936 | Yarbrough | 166/101 |
| 2,681,111 | 6/1954 | Thompson | 166/236 X |
| 2,842,211 | 7/1958 | McGaffey | 166/101 |
| 2,973,039 | 2/1961 | Payne, Jr. | 166/269 UX |
| 3,430,701 | 3/1969 | Canada | 166/269 |
| 3,455,382 | 7/1969 | Chenoweth | 166/269 X |
| 3,565,175 | 10/1969 | Wilson | 166/269 |
| 3,638,726 | 2/1972 | Sibley | 166/236 |
| 3,830,299 | 8/1974 | Thomeer | 166/269 X |

*Primary Examiner*—Stephen J. Novosad

*Attorney, Agent, or Firm*—Thomas H. Whaley; Carl G. Ries; Henry C. Dearborn

[57] ABSTRACT

A method and apparatus for controlling the injection profile of a borehole. It employs a perforated tube which may be attached to a tubing string for introducing an injection fluid opposite a formation to receive the injection. And, there is a perforated sleeve that is rotatable relative to the tube so that the injection fluid will be dynamically distributed over the extent of the perforated tube.

8 Claims, 5 Drawing Figures

METHOD AND APPARATUS FOR CONTROLLING THE INJECTION PROFILE OF A BOREHOLE

BACKGROUND OF THE INVENTION

1. Field of the Invention

This invention concerns borehole injection procedures and apparatus, in general. More specifically, it deals with a method and apparatus for controlling the injection profile of a borehole. The apparatus may also be useful in connection with cleaning a well-bore.

2. Description of the Prior Art

In carrying out injection procedures in boreholes, e.g. in connection with secondary recovery, the injection profiles obtained in the past have often been relatively poor because of the tendency of injected fluid to flow into formations at the point or points of least resistance. Thus, in a borehole where there is a variation in the permeability of the formations down hole, the spread of injection fluid (other factors being equal) tends to be in proportion to the permeability variation over the face of the borehole being subjected to injection. Consequently, highly permeable zones are swept rapidly while low permeability zones may have very little injection fluid introduced therein.

Also, when steam injection is employed, the condensed water which tends to form adds to the difficulties. This is because water in the borehole results in additional restriction of the injected steam, so that only a limited portion of the exposed borehole face may actually have the steam injected.

Furthermore, when the base of injection tubing is located opposite an exposed borehole formation, the fluid injection tends to concentrate at that point. It may be that water above and below limits the permeability to other fluids. Consequently, after injection fluid has entered the formation it tends to be confined vertically along bedding planes so that vertical coverage along the borehole may not be increased to any appreciable extent.

Consequently, it is an object of this invention to provide a method and apparatus that will permit the control of the rate of injection of an injection fluid over an entire borehole formation that is to be subjected to injection. In this manner an injection profile may be controlled so that improved reservoir sweep may be obtained for providing better and more economic flooding operations.

SUMMARY OF THE INVENTION

Briefly, the invention concerns a method of controlling the injection profile of a borehole. Such method comprises the steps of introducing a fixed perforated tube into said borehole adjacent to a predetermined formation, and flowing an injection fluid into said perforated tube. The method also comprises cyclically controlling the distribution of said injection fluid though said perforated tube in order to control the distribution of said fluid over said formation.

Again briefly, the invention concerns apparatus for controlling the injection profile of a borehole, which apparatus comprises in combination a perforated tube adapted for introduction into said borehole opposite a formation that is to receive an injection fluid. It also comprises a coaxial sleeve cooperating with said tube and having perforations for variable alignment and misalignment with said tube perforations, and means for dynamically moving said sleeve relative to said tube as said injection fluid is introduced into said borehole in order to control said injection profile.

Once more briefly, the invention concerns apparatus for controlling the injection profile of a borehole. Such apparatus comprises in combination, a tube having a plurality of longitudinal rows of ports and being adapted for introduction into said borehole opposite a formation that is to receive an injection fluid. It also comprises a coaxial sleeve inside said tube and having a plurality of longitudinal rows of ports disposed with angular displacements circumferentially around said sleeve that are different from the corresponding displacements of said tube rows of ports and low friction bearing means for supporting said sleeve for free rotation relative to said tube. It also comprises a plurality of impeller vanes associated with said sleeve for rotating the sleeve relative to said tube.

BRIEF DESCRIPTION OF THE DRAWINGS

The foregoing and other objects and benefits of the invention will be more fully set forth below in connection with the best mode contemplated by the inventor of carrying out the invention, and in connection with which there are illustrations provided in the drawings, wherein.

DESCRIPTION OF THE PREFFERED EMBODIMENTS

Figure 1:
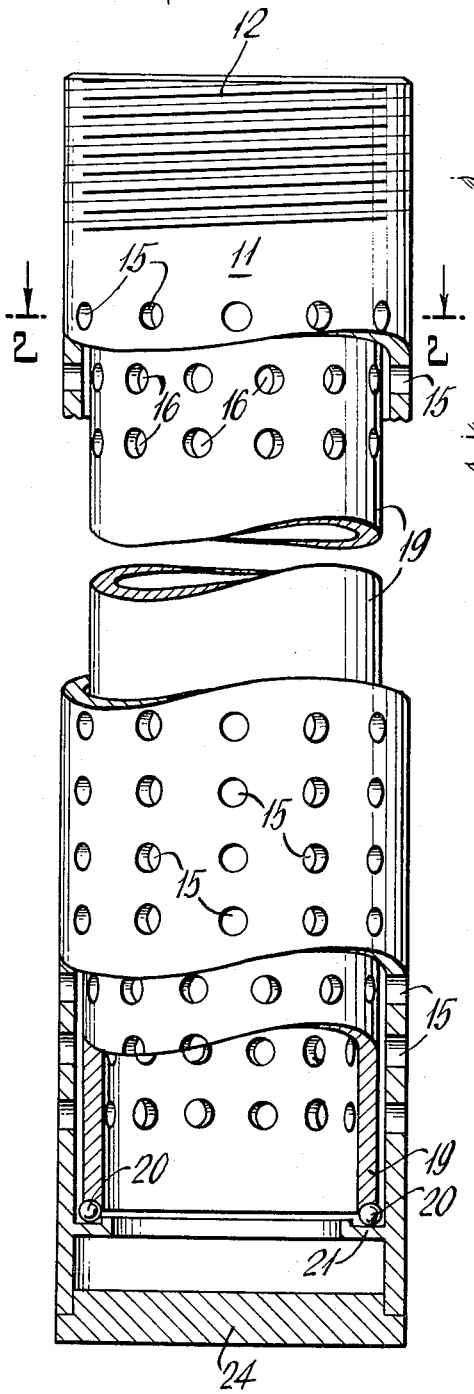
FIG. 1 is a schematic elevation partly broken away in cross-section showing an apparatus combination according to the invention.
Figure 2:
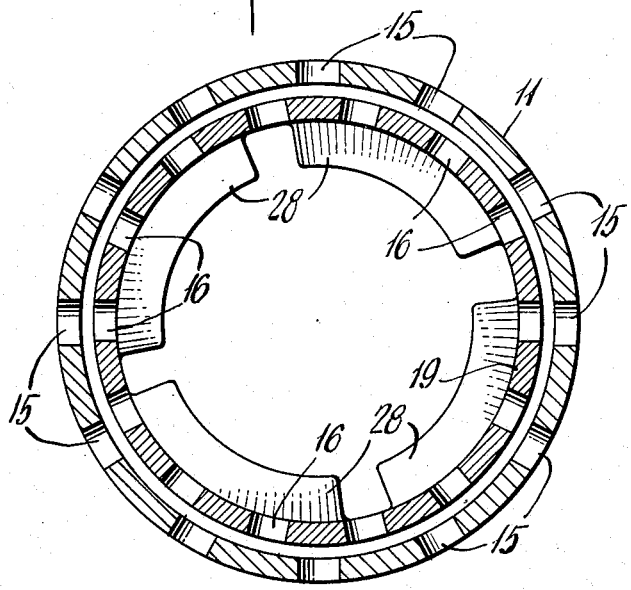
FIG. 2 is a cross-sectional view taken generally at the line 2—2 of FIG. 1 and looking in the direction of the arrows.

FIGS. 1 and 2 illustrate an embodiment of apparatus in acccordance with the invention. There is a tube 11 that has threads 12 at the upper end thereof for attachment to tubing that will support the tool in a borehole. The tube 11 has a plurality of longitudinal rows of ports 15. These rows extend longitudinally along the tube 11 and are spaced apart from one another around the periphery by predetermined equal radial angles.

The ports 15 permit passage of an injection fluid whenever individual ones of a corresponding plurality of longitudinal rows of ports 16 in a sleeve 19, are in alignment with the ports 15 through tube 11. The sleeve 19 is supported in a freely rotatable manner inside of tube 11 by being mounted for support on ball bearings 20 that are supported by an appropriate bracket structure 21 on the inside of the tube 11.

It will be noted that the lower end of sleeve 19 is open for permitting flow of injection fluid. However, it may be desirable to employ a solid disc 24 at the bottom end of the tube 11 when this unit is the lowermost of a number of such units attached to the borehole tubing which supports the apparatus.

It will be appreciated that there may be additional ball bearings and supports (not shown) near the upper end of the sleeve 19 to help support the sleeve in coaxial alignment inside of the tube 11. It will also be appreciated that the clearances shown are exaggerated to illustrate the principles of the invention. It will be understood that it is desirable to have the fluid passages provide for free flow of an injection fluid through a longitudinal row of the ports 16 and then the corresponding ports 15 whenever given rows of such ports are in alignment.

In order to provide for rotation of the sleeve 19, there is an impeller which might take various forms. Such an impeller is indicated in FIG. 2. There are a plurality of vanes 28 that are integrally attached to the inside surface of the sleeve 19. They are preferably located longitudinally above the ports 16 (as viewed in FIG. 1) in the sleeve 19 even though, for the purposes of illustration, they are shown at the same location as the upper rings of ports in FIG. 2. It will be appreciated that the vanes 28 are attached with a helical configuration so that the flow of injection fluid over the vanes will cause rotation of the sleeve 19 relative to the tube 11.

It will be observed that there are a larger number of longitudinal rows of the ports 16 in the sleeve 19 than the number of corresponding rows of ports 15 in the tube 11. However, each of the individual ports of both rows are located at the same longitudinal, i.e. axial position, relative to one another so that when one of the rows in sleeve 19 is in radial alignment with a row in tube 11, all of the ports of both rows are aligned. Consequently, as the sleeve 19 rotates, the separate rows of ports 16 will successively pass into and out of alignment with corresponding rows of ports 15 in the tube 11. Therefore, the injection fluid will be controlled in a sequential manner for being directed out into the surrounding formation of the borehole.

Figure 5:
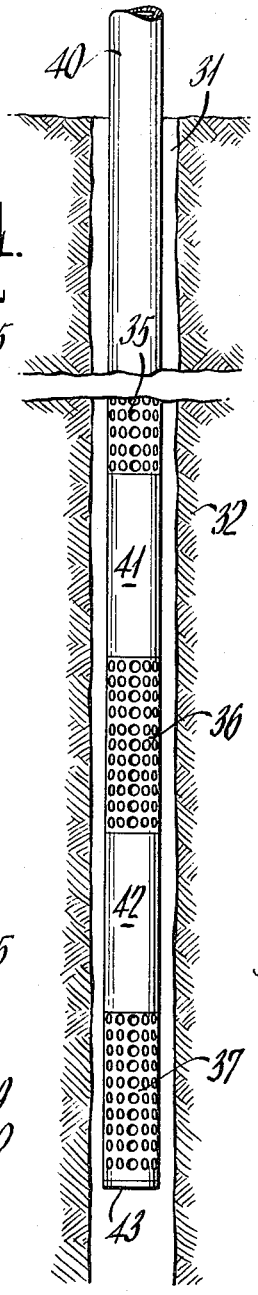
FIG. 5 is a schematic longitudinal cross-section of a borehole, showing therein a tubing with a plurality of units according to the invention attached to the lower end thereof.

FIG. 5 illustrates how a plurality of units, e.g. like the one illustrated in FIGS. 1 and 2, may be mounted for use in a borehole. Thus, FIG. 5 illustrates a borehole 31 that extends down through a formation 32, into which an injection fluid is to be projected. A plurality of injection control units 35, 36 and 37 may be supported in the borehole 31 by attachment to the lower end of a borehole tubing string 40. Also, it may be desirable to space these units apart by having imperforate tubing sections 41 and 42 therebetween, as illustrated. It will be appreciated that when a plurality of the units are attached to one another, with or without spacer sections, only the lowermost of them will include a closure disc 43 which is like disc 24 of the unit illustrated in FIG. 1 and located at the bottom of the tube 11.

It will be appreciated that the sleeve 19 might be designed so as to be situated outside of the tube 11. However, this would be relatively impractical because of the tendency for it to become damaged as the units would be lowered into and operated in a borehole.

Figure 3:
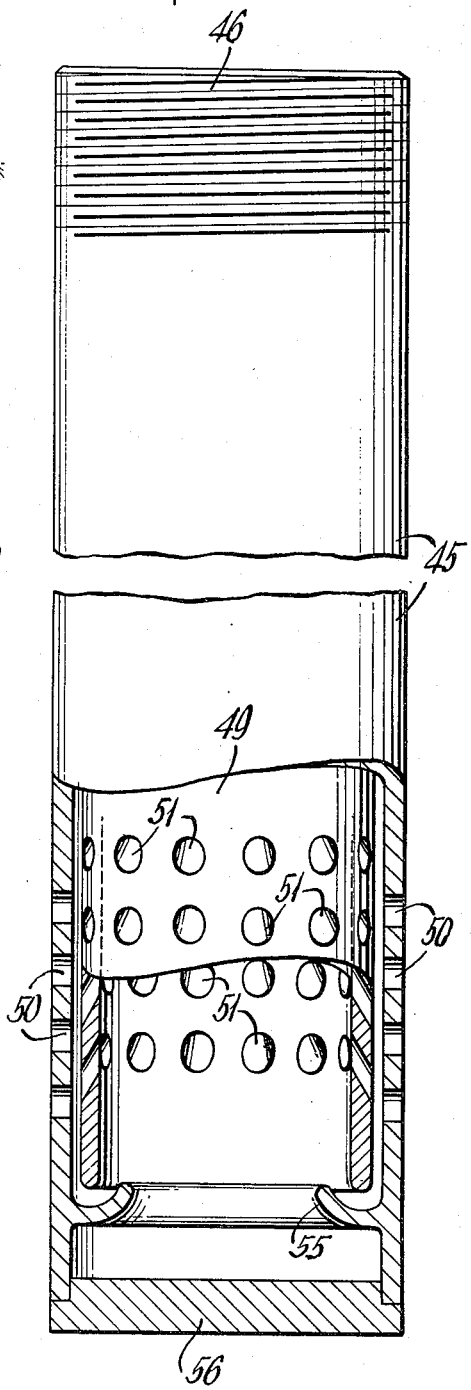
FIG. 3 is another elevation partly broken away in cross-section, illustrating a different embodiment of apparatus according to the invention.

FIG. 3 illustrates another embodiment of apparatus according to the invention. In this case, there is a tube 45 having a threaded upper end 46. This is for attaching the unit to a tubing string or to another unit, in a manner similar to that described above in connection with the apparatus shown in FIGS. 1 and 5. Also, there is an inner rotatable sleeve 49 that has an impeller structure (not shown) of any feasible type, e.g. like the helical vanes 28 illustrated in FIG. 2 of the FIG. 1 modification.

The tube 45 has plural set of ports 50 that are substantially similar to the ports 15 of the FIG. 1 modification. Also, the sleeve 49 has a plurality of longitudinal rows of ports 51. But, in this case the ports 51 are sloped or slanted downward as viewed in FIG. 3, i.e. as the tool would be situated vertically in the borehole. This construction is in order to provide a vertical thrust by reaction as the injection fluid flows through these ports 51 and out through the ports 50 of the tube 45. Such vertical thrust will tend to raise the sleeve 49 within the tube 45 and lift it up off of a support bracket 55 upon which the sleeve rests in the absence of injection fluid flow. This arrangement obviates the need for ball bearing supports, since it effectively causes the sleeve 49 to float within the tube 45 as the injection fluid is flowing through the apparatus.

Here again, as was the case in the FIG. 1 modification, the lower end of the tube 45 may have a solid disc 56 to close the opening, especially if the unit is to be the lowermost one of a plurality of such units.

Figure 4:
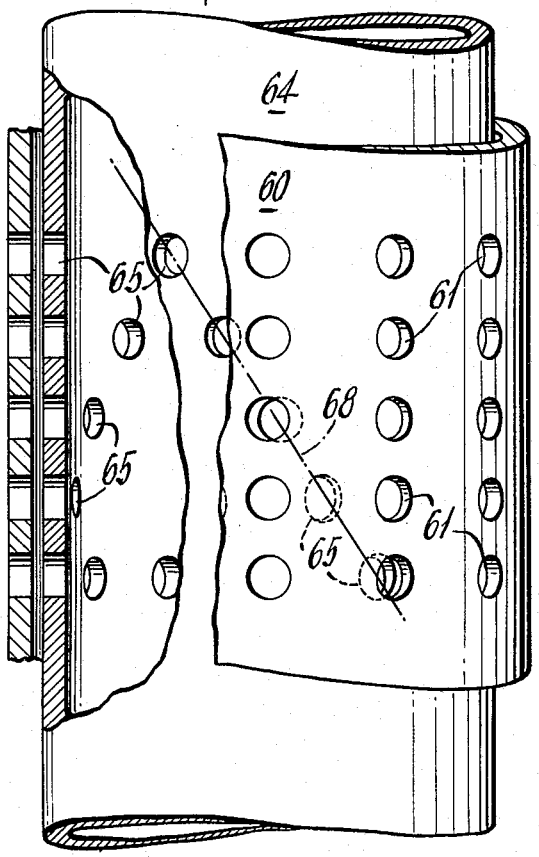
FIG. 4 is an enlarged partial elevation, partly broken away in cross-section, illustrating another embodiment of the apparatus according to the invention.

FIG. 4 illustrates still another modification. This varies the manner of locating ports through the elements of a unit. It will be understood that the elements of this modification which are not illustrated may be like those shown and described in connection with the other two modifications. The FIG. 4 structure provides for making cyclical shifting of the location of aligned ports to be in a vertical manner along the apparatus, as well as laterally around the periphery thereof.

Thus, in FIG. 4 there is a tube 60 which has a plurality of longitudinal rows of ports 61 that are substantially like the rows of ports 15 and 50 of the FIGS. 1 and 3 modifications, respectively. However, in the FIG. 4 modification there is a sleeve 64 which has a plurality of ports 65 there through that have the longitudinal rows thereof skewed relative to the rows of ports 61 through the tube 60. This is indicated by a dashed center-line 68 which passes through the center of a longitudinal group of the ports 65 in the sleeve 64. It will be appreciated that by having this structure, when the sleeve 64 rotates relative to the tube 60, the alignment of ports 65 with the ports 61 will take place in steps moving longitudinally along the tube 60 in addition to moving laterally from one row of ports 61 to the next.

It will appreciated that other arrangements for providing control of an injection profile over a predetermined portion of a formation or portion of a borehole, might be employed. Consequently, a method according to this invention is not limited by the particular apparatus which may be employed to carry it out. The steps of such a method include, but not necessarily exclusively, each of the following steps.

The step of introducing a fixed perforated tube into borehole adjacent a predetermined formation. This step provides for the location of means to carry out the controlled injection steps which follow.

Another step is that of flowing an injection fluid into the foregoing perforated tube so that it will tend to be directed through the perforations and into the formation or borehole wall at the location of the tube.

Another step is that of cyclically controlling the distribution of the injection fluid as it passes through the perforated tube, in order to control the distribution of the fluid over the face of the formation or formations at the location of the apparatus.

By making use of this invention, the tendency to have uneven distribution with injection of fluid in a borehole has been overcome. Consequently, a greatly improved or controlled injection of fluid into formations downhole may be had.

While particular embodiments of the invention have been described above in considerble detail in accordance with the applicable statutes, this is not to be taken as in any way limiting the invention but merely as being descriptive thereof.

I claim:

1. Apparatus for controlling the injection profile of a borehole, comprising in combination a perforated tube adapted for introduction into said borehole opposite a formation that is to receive an injection fluid, a coaxial sleeve cooperating with said tube and having perforations for variable alignment and misalignment with said tube perforations, and means for dynamically moving said sleeve relative to said tube as said injection fluid is introduced into said borehole in order to control said injection profile.

2. Apparatus for controlling the injection profile of a borehole according to claim 1, wherein said means for dynamically moving comprises impeller means for rotating said sleeve relative to said tube.

3. Apparatus for controlling the injection profile of a borehole according to claim 2, wherein said coaxial sleeve is inside said tube, said tube perforations comprise a plurality of longitudinal rows of ports, and said sleeve perforations comprise a plurality of longitudinal rows of ports.

4. Apparatus for controlling the injection profile of a borehole, according to claim 3 wherein said sleeve perfortion rows are skewed relative to said tube perforation rows.

5. Apparatus for controlling the injection profile of a borehole according to claim 3, wherein said sleeve perforation rows are disposed with angular displacements circumferentially around said sleeve different from the corresponding displacements of said tube perforation rows in order to cause cyclical alignment of said rows as said sleeve rotates.

6. Apparatus for controlling the injection profile of a borehole according to claim 3, further comprising low friction bearing means for supporting said sleeve for free rotation.

7. Apparatus for controlling the injection profile of a borehole according to claim 3, further comprising means for applying a dynamic thrust to said sleeve by said injection fluid flow to suspend said sleeve for free rotation.

8. Apparatus for controlling the injection profile of a borehole, comprising in combination a tube having a plurality of longitudinal rows of ports and being adapted for introduction into said borehole opposite a formation that is to receive an injection fluid, a coaxial sleeve inside said tube and having a plurality of longitudinal rows of ports disposed with angular displacements circumferentially around said sleeve different from the corresponding displacements of said tube rows of ports.

low friction bearing means for supporting said sleeve for fee rotation relative to said tube, and a plurality of impeller vanes associated with said sleeve for rotating the sleeve relative to said tube.

* * * * *